US005863880A

United States Patent [19]

Shih et al.

[11] Patent Number: 5,863,880

[45] Date of Patent: Jan. 26, 1999

[54] LAUNDRY DETERGENT COMPOSITIONS CONTAINING WATER SOLUBLE DYE COMPLEXING POLYMERS

[75] Inventors: Jenn S. Shih, Paramus; Bala Srinivas, Hasbrouck Heights; John C. Hornby, Washington Township, all of N.J.

[73] Assignee: ISP Investments Inc., Wilmington, Del.

[21] Appl. No.: 105,666

[22] Filed: Jun. 26, 1998

Related U.S. Application Data

[63] Continuation-in-part of Ser. No. 932,448, Sep. 19, 1997, Pat. No. 5,776,879.

[51] Int. Cl.[6] ..... C11D 3/37

[52] U.S. Cl. ..... 510/361; 510/476

[58] Field of Search ..... 510/361, 476, 510/513; 526/265, 318.1

[56] References Cited

U.S. PATENT DOCUMENTS

| | | | |
|---|---|---|---|
| 4,452,878 | 6/1984 | Locatell, Jr. et al. | 430/215 |
| 5,459,007 | 10/1995 | Larson et al. | 430/115 |
| 5,573,882 | 11/1996 | Larson et al. | 430/115 |
| 5,776,879 | 7/1998 | Shih et al. | 510/361 |

FOREIGN PATENT DOCUMENTS

| | | |
|---|---|---|
| 0231038 B1 | 5/1991 | European Pat. Off. . |

OTHER PUBLICATIONS

V.A. Kabanov, A.A. Yaroslavov, S.A. Sukhishvili, Journal of Controlled Release, 1996, vol. 39, pp. 173–189, Jan. 1996.

C. Luca, V. Barboiu, I. Petrariu, M. Dima, Journal of Polymer Science, Polymer Chemistry Edition, 1980, 2347–2355, Jun. 1980.

*Primary Examiner*—Paul Lieberman
*Assistant Examiner*—John R. Hardee
*Attorney, Agent, or Firm*—Walter Katz; William J. Davis; Marilyn J. Maue

[57] ABSTRACT

A laundry detergent composition suitable for washing colored fabrics includes a water soluble poly(4-vinylpyridine betaine) polymer containing a quaternary nitrogen and a carboxylate salt as a dye transfer inhibitor therein.

20 Claims, No Drawings

LAUNDRY DETERGENT COMPOSITIONS CONTAINING WATER SOLUBLE DYE COMPLEXING POLYMERS

CROSS-REFERENCE TO RELATED U.S. PATENT APPLICATIONS

This application is a continuation-in-part of U.S. patent application Ser. No. 08/932,448, now U.S. Pat. No. 5,776,879, filed Sep. 19, 1997, by the same inventors as herein and assigned to the same assignee.

BACKGROUND OF THE INVENTION

1. Field of the Invention

This invention relates to detergent compositions suitable for washing colored fabrics, and more particularly, to laundry detergent compositions containing a water soluble poly (4-vinylpyridine betaine) polymer as a dye transfer inhibitor (DTI) therein.

2. Description of the Prior Art

Dye complexing polymers have been used in laundry detergent and fabric softener compositions. However, during washing a mixture of colored and white fabrics, some of the dyes may bleed out of a colored fabric under washing conditions. The degree of bleeding is influenced by the structure of the dye, the type of cloth and the pH, temperature and mechanical efficiency of the agitation process. The bled dye in the wash liquor can be totally innocuous and get washed off in the wash liquor. However, in reality, this fugitive dye has a tendency to redeposit either onto the same fabric or onto another fabric leading to patches and an ugly appearance of the washed material. This redeposition of the bled dye can be inhibited in several ways. One method is to introduce a DTI compound which can complex with the fugitive dye and get washed off thus preventing redeposition.

Polyvinylpyrrolidone (PVP), by virtue of its dye complexation ability, has been used to inhibit dye deposition during washing of colored fabrics under laundry conditions. The performance of PVP as a DTI, however, is adversely affected by the presence of anionic surfactants in the washing process.

Other polymers which have been used as DTIs in laundry detergent compositions include polyvinylpyridine N-oxide (PVPNO); polyvinylimidazole (PVI); and copolymers of polyvinylpyridine and polyvinylimidazole (PVP-PVI).

The prior art in this field is represented by the following patents and publications:

| Patent | Subject Matter |
|---|---|
| (l) JP 53-50732 | Formulas Nos. 3, 6 and (l) are water insoluble compounds and polymers used in printing ink compositions; |
| (2) PCT/US94/06849 WO 95/03390 | Dye inhibiting composition polymers of PVP, polyamine N-oxide, vinylimidazole are used in laundry detergent compositions; |
| (3) USP 5,460,752 | Polyamine N-oxide polymers described for use in laundry detergent compositions; |
| (4) EPA 664335 A1 | Polysulfoxide polymers; |
| (5) PCT/US93/10542 WO 94/11473 | Laundry compositions include polyamine-N-oxide and brighteners and surfactants; |
| (6) PCT/EP93/02851 WO 94/10281 | PVP and PVI are present in laundry compositions; |

-continued

| Patent | Subject Matter |
|---|---|
| (7) PCT/US94/11509 WO 95/13354 | Poly (4-vinylpyridine-N-oxide) (PVPNO) and copolymers of VP and VI are described; |
| (8) EP 754748 A1 | Vinylpyridine copolymers and formic acid; |
| (9) EP 0664332A1 | Polyamine oxide polymers; |
| (10) USP 5,604,197 | PVPNO + clay softening; |
| (11) USP 5,458,809 | PVPNO; |
| (12) USP 5,466,802 | PVPNO and PVP-VI; |
| (13) USP 5,627,151 | Copolymers of VP or VI; vinylpyridine or dimethylaminoethyl methacrylate or dimethylaminopropylmethacrylamide, including up to 20% vinylacetate; |
| (14) PCT/US95/04019 WO 95/27038 | PVPNO, PVP, PVP-PI and copolymers of VP and VI; |
| (15) EPA 628624 A1 | PVPNO with protease; |
| (16) DE 4224762 A1 | VP polymers; |
| (17) J. Polymer Sci. 26, No. 113, p. 25–254 (1957) | Water-insoluble poly(4-vinylpyridine) compounds and polymers |
| (18) W09723591 | Anionic alkylbenzene sulfonate and non-ionic surfactants in detergent compositions containing PVP/PVI copolymers |

Accordingly, it is an object of this invention to provide laundry detergent compositions including a water soluble dye transfer inhibitor (DTI) polymer which is a water soluble poly(4-vinylpyridine betaine) containing both a quaternary nitrogen and a carboxylate salt.

Another object of the invention is to provide such laundry detergent compositions suitable for washing colored fabrics alone or with white fabrics even in the presence of anionic surfactants.

SUMMARY OF THE INVENTION

The laundry detergent compositions of the present invention includes a water soluble poly(vinylpyridine betaine) as DTI polymer therein. This water soluble polymer contains both a quaternary nitrogen and a carboxylate salt; its formula is shown below:

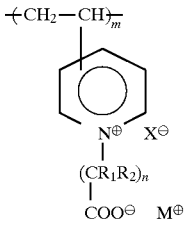

where m is indicative of the degree of polymerization;

X is an anion;

$R_1$ and $R_2$ are independently hydrogen, alkyl or aryl;

n is 1–5; and

M is a cation.

Preferred polymers are those in which X is a halide; most preferably chloride or bromide; $R_1$ and $R_2$ are both hydrogen; n is 1; M is an alkali metal; preferably sodium or potassium; and the polymer is 25–100% quaternized; most preferably 75–100%.

A preferred polymer also has a weight average molecular weight of about 1,000 to 1,000,000; preferably 5,000–200,000, where m is about 5–5,000, preferably 20–1,000.

Water soluble copolymers of the defined polymer above with polymerizable monomers, such as vinyl pyrrolidone, vinyl imidazole, acrylamide and vinyl caprolactam also are useful herein.

DETAILED DESCRIPTION OF THE INVENTION

In accordance with the invention, the DTI polymer of the laundry detergent composition herein is a water soluble poly(4-vinylpyridine betaine) containing both a quaternary nitrogen and a carboxylate salt. This polymer has dye completing properties, particularly dye transfer inhibitor properties, which makes them particularly useful in laundry applications, where colored fabrics, even with white fabrics, are being washed. These polymers have the formula:

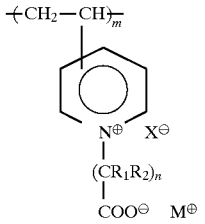

where m is indicative of the degree of polymerization;

X is an anion;

$R_1$ and $R_2$ are independently hydrogen, alkyl or aryl;

n is 1–5; and

M is a cation.

Preferred embodiments of the invention are polymers in which X is a halide; most preferably chloride or bromide; $R_1$ and $R_2$ are both hydrogen; n is 1; M is an alkali metal; preferably sodium or potassium; and the polymer is 25–100% quaternized; most preferably 75–100%.

A preferred polymer also has a weight average molecular weight of about 1,000 to 1,000,000; preferably 5,000 to 200,000, where m is about 5–5,000, preferably 20–1,000.

Water soluble copolymers of the defined polymer above with polymerizable monomers, such as vinyl pyrrolidone, vinyl caprolactam, vinyl imidazole, n-vinyl formamide, and acrylamide also are useful herein.

The DTI polymer and copolymers herein generally are used in laundry detergent compositions in an amount of about 0.001–15 wt. % of the composition, preferably about 0.01–10 wt. %, and most preferably, about 0.1–5 wt. %.

In a preferred embodiment of the invention, the water soluble polymers of the invention are made by polymerizing a vinylpyridine under suitable polymerization conditions to form a poly(vinylpyridine) intermediate, and then reacting the intermediate polymer with sodium chloroacetate in an aqueous medium. The reaction product is a poly (vinylpyridine betaine) polymer containing a quaternary nitrogen and a carboxylate salt.

In the polymerization step, which may be solution, precipitation or emulsion polymerization, any suitable solvent may be used, for example, an alcohol, such as methanol, ethanol or isopropanol; water; or mixtures of water and alcohol. The reaction temperature is about 40° to 150° C., preferably 50° to 90° C., and most preferably about 60° to 85° C. The polymerization initiator is a free radical initiator, such as perester, peroxide, percarbonate, or Vazo® type initiators may be used. The polymerization is carried out at a solids level of about 5 to 80%, preferably 20 to 50%.

A preferred polymer* made herein is poly(4-vinylpyridine) sodium carboxymethyl betaine chloride having the formula:

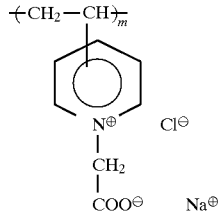

* POLYMER A

SURFACTANT SYSTEM:

The compositions according to the present invention comprise in addition to the water soluble poly(vinylpyridine betaine) polymers a surfactant system wherein the surfactant can be selected from nonionic and/or anionic and/or cationic and/or ampholytic and/or zwitterionic and/or semi-polar surfactants.

Anionic surfactants may be used in the compositions of the invention without being affected by the presence of the DT1 polymer therein.

ANIONIC SURFACTANTS:

Suitable anionic surfactants include alkyl alkoxylated sulfate surfactants, water soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl, dimethyl, trimethyl-ammonium cations and quaternary ammonium cations such as tetramethyl-ammonium and dimethyl piperdinium cations and those derived from alkylamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}$E(1.0)M), $C_{12}$–$C_{18}$ alkyl polyethoxylate (2.25) sulfate ($C_{12}$–$C_{18}$E(2.25)M), $C_{12}$–$C_{18}$ alkyl polyethoxylate (3.0)sulfate ($C_{12}$–$C_{18}$E(3.0)M), and $C_{12}$–$C_{18}$ alkyl polyethoxylate (4.0) sulfate ($C_{12}$–$C_{18}$E(4.0)M), wherein M is conveniently selected from sodium and potassium.

Suitable anionic surfactants to be used are alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

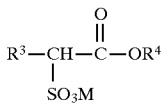

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate.

Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other suitable anionic surfactants include the alkyl sulfate surfactants, water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably $C_{12}$–$C_{18}$ alkyl or hydroxyalkyl, and M is H or a cation, e.g., an alkali metal cation (e.g. sodium, potassium, lithium), or ammonium or substituted ammonium (e.g. methyl, dimethyl, and trimethyl ammonium cations and quaternary ammonium cations derived from alkylamines such as ethylamine, diethylamine, triethylamine, and mixtures thereof, and the like). Typically, alkyl chains of $C_{12}$–$C_{16}$ are preferred for lower wash temperatures (e.g. below about 50° C.) and $C_{16}$–$C_{18}$ alkyl chains are preferred for higher wash temperatures (e.g. above about 50° C.).

Other anionic surfactants useful for detersive purposes can also be included in the laundry detergent compositions of the present invention. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates, sulfates of alkylpolysaccharides such as the sulfates of alkylpolyglucoside (the nonionic nonsulfated compounds being described blow), branched primary alkyl sulfates, and alkyl polyethoxy carboxylates such as those of the formula $RO(CH_2CH_2O)_k$—$CH_2COO$—M+ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

When included therein, the laundry detergent compositions of the present invention typically comprise from about 5 to about 50%, preferably from about 10% to about 40% by weight of such anionic surfactants.

The laundry detergent compositions of the present invention may also contain nonionic, cationic, ampholytic, zwitterionic, and semi-polar surfactants, as well as nonionic surfactants other than those already described herein.

NONIONICS:

Polyethylene, polypropylene, and polybutylene oxide condensates of alkyl phenols are suitable for use as the nonionic surfactant of the surfactant systems of the present invention, with the polyethylene oxide condensates being preferred. These compounds include the condensation products of alkyl phenols having an alkyl group containing from about 6 to about 14 carbon atoms, preferably from about 8 to about 14 carbon atoms, in either a straight-chain or branched-chain configuration with the alkylene oxide. In a preferred embodiment, the ethylene oxide is present in an amount equal to from about 1 to about 25 moles, more preferably from about 3 to about 15 moles, of ethylene oxide per mole of alkyl phenol. Commercially available nonionic surfactants of this type include Triton™ X-45, X-114, X-100 and X-102, all marketed by the Rohm & Haas Company. These surfactants are commonly referred to as alkylphenol alkoxylates (e.g., alkyl phenol ethoxylates).

The condensation products of primary and secondary aliphatic alcohols with from about 1 to about 25 moles of ethylene oxide are suitable for use as the nonionic surfactant of the nonionic surfactant systems of the present invention. The alkyl chain of the aliphatic alcohol can either be straight or branched, primary or secondary, and generally contains from about 8 to about 22 carbon atoms. Preferred are the condensation products of alcohols having an alkyl group containing from about 8 to about 20 carbon atoms, more preferably from abut 10 to about 18 carbon atoms, with from about 2 to about 10 moles of ethylene oxide per mole of alcohol. Examples of commercially available nonionic surfactants of this type include Tergitol™ 15-S-9 (the condensation product of $C_{11}$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45–9 (the condensation product of $C_{14}$–$C_{15}$ linear alcohol with 9 moles of ethylene oxide), Neodol™ 23-6.5 (the condensation product of $C_{12}$–$C_{13}$ linear alcohol with 6.5 moles of ethylene oxide), Neodol™ 45-7 (the condensation product of $C_{14}$–$C_{15}$ linear alcohol with 7 moles of ethylene oxide), Neodol™ 45-4 (the condensation product of $C_{14}$–$C_{15}$ linear alcohol with 4 moles of ethylene oxide) marketed by Shell Chemical Company, and Kyro™ EOB (the condensation product of $C_{13}$–$C_{15}$ alcohol with 9 moles ethylene oxide), marketed by The Procter & Gamble Company.

Also useful as the nonionic surfactant of the surfactant systems of the present invention are the alkylpolysaccharides disclosed in U.S. Pat. No. 4,565,647, Llenado, issued Jan. 21, 1986, having a hydrophobic group containing from about 6 to about 30 carbon atoms and a polysaccharide, e.g. a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties (optionally the hydrophobic group is attached at the 2-, 3-, 4-, etc. positions thus giving a glucose or galactose as opposed to a glucoside or galactoside). The intersaccharide bonds can be, e.g., between the one position of the; additional saccharide units and the 2-, 3-, 4-, and/or 6-positions on the preceding saccharide units.

Optionally, and less desirably, there can be a polyalkylene-oxide chain joining the hydrophobic moiety and the polysaccharide moiety. The preferred alkyleneoxide is ethylene oxide. Typically hydrophobic groups include alkyl groups, either saturated or unsaturated, branched or unbranched containing from about 8 to about 18, preferably from about 10 to about 16, carbon atoms, Preferably, the alkyl group is a straight chain saturated alkyl group. The alkyl group can contain up to about 3 hydroxy groups and/or the pqlyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxyalcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

Although not preferred, the condensation products of ethylene oxide with a hydrophobic base formed by the condensation of propylene oxide with propylene glycol are also suitable for use as the additional nonionic surfactant of the nonionic surfactant systems of the present invention. The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic™ surfactants, marketed by BASF.

Also suitable for use as the nonionic surfactant of the nonionic surfactant system of the present invention, are the condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic™ compounds, marketed by BASF.

Preferred for use as the nonionic surfactant of the surfactant systems of the present invention are polyethylene oxide condensates of alkyl phenols, condensation products of primary and secondary aliphatic alcohols with from about 1 to about 25 moles of ethylene oxide, alkylpolysaccharides, and mixtures thereof. Most preferred are $C_8$–$C_{14}$ alkyl phenol ethoxylates having from 3 to 15 ethoxy groups and $C_8$–$C_{18}$ alcohol ethoxylates (preferably $C_{10}$ avg.) having from 2 to 10 ethoxy groups, and mixtures thereof.

Highly preferred nonionic surfactants are polyhydroxy fatty acid amine surfactants.

Also suitable as nonionic surfactants are poly hydroxy fatty acid amide surfactants of the formula

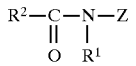

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{1-15}$ alkyl or alkenyl chain such as coconut alkyl or mixtures thereof, and maltose, lactose, in a reductive amination reaction.

It is preferred that the level of non-ionic surfactant is from 1 wt % to 35 wt %. The ratio of anionic to non-ionic surfactant is from 7:3 to 90:1, preferably 3:1 to 60:1. The total amount of surfactant present will also depend on the intended use and may be as high as 65 wt %. However, for machine washing fabrics, an amount of 5 to 40 wt % is most appropriate.

Preferred cationic surfactant systems include nonionic and ampholytic surfactants. Cationic detersive surfactants suitable for use in the laundry detergent compositions of the present invention are those having one long-chain hydrocarbyl group. Examples of such cationic surfactants include the ammonium surfactants such as alkyldimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain, each $R^3$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, $—CH_2CHOH—CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

The detergent compositions of the invention will generally also contain one or more detergency builders. The total amount of detergency builder in the compositions will suitably range from 5 to 80 wt %, preferably from 10 to 60 wt %.

Inorganic builders that may be present include sodium carbonate, if desired in combination with a crystallization seed for calcium carbonate, as disclosed in GB 1 437 950 (Unilever); crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst).

Inorganic phosphate builders, for example, sodium orthophosphate, pyrophosphate and tripolyphosphate are also suitable for use with this invention.

The detergent compositions of the invention preferably contain an alkali metal, preferably sodium, aluminosilicate builder. Sodium aluminosilictes may as generally be incorporated in amounts of from 10 to 70% by weight (anhydrous basis), preferably from 25 to 50 wt %.

The alkali metal aluminosilicate may be either crystalline or amorphous or mixtures thereof, having the general formula:

$$0.8\text{–}1.5\ Na_2O.\ Al_2O_3.\ 0.8\text{–}6\ SiO_2$$

These materials contain some bound water and are required to have a calcium ion exchange capacity of at least 50 mg CaO/g. The preferred sodium aluminosilicates contain. 1.5–3.5 $SiO_2$ units (in the formula above). both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminum zeolite P (zeolite MAP) as described and claimed in EP 384 070A (Unilever). Zeolite MAP is defined as an alkali metal aluminosilicate of the zeolite P type having a silicon to aluminum ratio not exceeding 1.33, preferably within the range of from 0.90 to 1.33, and more preferably within the range of from 0.90 to 1.20.

Especially preferred is zeolite MAP having a silicon to aluminum ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

The detergent compositions according to the present invention can be in liquid, paste or granular forms. Such compositions can be prepared by combining the essential and optional components in the requisite concentrations in any suitable order and by an y conventional means.

Granular compositions, for example, are generally made by combining base granule ingredients (e.g. surfactants, builders, water, etc.) as a slurry, and spray drying the resulting slurry to a low level of residual moisture (5–12%). The remaining dry ingredients can be admixed in granular powder form with the spray dried granules in a rotary mixing drum and the liquid ingredients (e.g. enzymes, binders and perfumes) can be sprayed onto the resulting granules to form the finished detergent composition. Granular compositions according to the present invention can also be in "compact form", i.e. they may have a relatively higher density than conventional granular detergents, i.e. from 550 to 950 g/l. In such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt.

Liquid detergent compositions can be prepared by admixing the essential and optional ingredients thereof in any desired order to provide compositions containing components in the requisite concentrations. Liquid compositions according to the present invention can also be in "compact form", in such case, the liquid detergent compositions according to the present invention will contain a lower amount of water, compared to conventional liquid detergents.

The invention will now be illustrated by the following examples, in which:

EXAMPLE 1

A 1-liter, 4-necked resin kettle was fitted with an anchor agitator, a nitrogen purge adaptor, a thermometer, two subsurface feeding tubes connected with two feeding pumps, and a reflux condenser. The kettle was charged with 150 g of 4-vinylpyridine and 150 g of isopropanol. Nitrogen purging was started and continued throughout the process as was agitation at 200 rpm. Then the reactants were heated to 80° C. in 20 minutes and held at that for 30 minutes. Then 390 microliter of t-butyl peroxypivalate (Lupersol® 11) was charged. The solution polymerization reaction was carried out at 80° C. for 2 hours. Then a 195 microliter portion of Lupersol® 11 was added and reaction continued at 80° C for another two hours. The latter step was repeated another 6 times. Then 150 g water and 166.2 g of sodium chloroacetate was charged and the contents were rinsed with 100 g of water. The resultant mixture was heated to remove 100 g of distillate then 100 g of water was added to the mixture; the step was repeated and yet another 50 g of distillate was removed. Then the mixture was cooled to room temperature. The product was obtained as a solution whose solids level was adjusted to about 48%.

EXAMPLE 2

The process of Example 1 was repeated using 125 g of sodium chloroacetate. A similar product was obtained.

EXAMPLE 3

The process of Example 1 was repeated using 83 g of sodium chloroacetate. A similar product was obtained.

EXAMPLE 4

A 1-l, 4-necked resin kettle, fitted with an anchor agitator, a nitrogen purge adaptor, a thermometer and a reflux condenser, was charged with 50 g of 4-vinylpyridine, 50 g of vinylpyrrolidone and 150 g of isopropanol. Nitrogen purging was started and continued throughout the reaction, and the agitator was set at 20 rpm. The reactants were heated from ambient temperature (20°–25° C.) to 80° C. in 20 minutes and held at 80° C. for 30 minutes. Then 0.1 (based on total weight of monomers) of t-butyl peroxypivalate (Lupersol® 11) was charged into the kettle and the reaction temperature was held at 80° C. for 2 hours. Thereafter 0.05% (based on total weight of monomers) of Lupersol® 11 was added every 2 hours and the reaction temperature was held at 80° C. until the residual 4-vinylpyridine level was reduced to less than 2%.

Then 250 g of water and 55.4 g of sodium chloroacetate were mixed and charged. The mixture was heated to remove the distillate. Additional water was added while removing distillate until all the ethanol was removed at about 105° C. The final solids level was controlled by addition of water to the final product.

EXAMPLE 5

Example 4 was repeated using 25 g of 4-vinylpyridine, 75 g of vinylpyrrolidone and 27.7 g of sodium chloroacetate, with similar results.

EXAMPLE 6

Example 1 was repeated using 186.5 g of sodium 2-chloropropionate in place of sodium chloroacetate with similar results.

EXAMPLE 7

Example 1 was repeated using 186.5 g of sodium 1-chloropropionate with similar results.

EXAMPLE 8

A 1-l, 4-necked resin kettle, fitted with anchor agitator, a nitrogen purge adaptor, a thermometer and a reflux condenser was charged with 150 g of 4-vinylpyridine and 150 g of isopropanol. The reactants were heated from ambient temperature (20°–25° C.) to 80° C. in 20 minutes and held at 80° C. for 30 minutes. Then 0.1% (based on total weight of monomers) of t-butyl peroxypivalate (Lupersol® 11) was charged into the kettle and the reaction temperature was held at 80° C. for 2 hours. Then 0.05% (based on total weight of monomers) of Lupersol® 11 was added every 2 hours at 80° C. until residual 4-vinylpyridine was reduced to less than 2%.

The reaction mixture was cooled to 40° C. and 250 g of water and 57.2 g of sodium hydroxide were mixed and charged. Then 135.1 g of chloroacetic acid was pumped into the reactor by melting chloroacetic acid. The mixture was heated to remove the distillate, and water was added while removing distillate until all the ethanol was removed.

TEST RESULTS

EXAMPLE 9

The effectiveness of the polymers of the invention as a DTI additive in a laundry detergent composition was tested against control and other known DTI polymers in a test simulating actual laundry washing conditions. The test was carried out on a composition containing 10 ppm of the polymer, 10 ppm of a dye and 1 g/l of a laundry detergent which contained a mixture of both an anionic and a nonionic surfactant. The solution was diluted with water to 1-l.

Three white cotton cloth swatches #400 (bleached and desized) were immersed in the test solution at 100° F. and the solutions were agitated for 10 minutes in a Terg-o-tometer (Instrument Marketing Services Co.). The cloths were then removed, excess solution squeezed out, the cloths washed again in clean water for 3 minutes, squeezed again and dried. Reflectance measurements were taken on this test material on a calorimeter. The reflectance readings were recorded as ΔE, which is a composite of the degree of whiteness, redness and blueness indices in the dyed cloth. These readings were taken as a direct measure of the degree of dye deposition under the test washing conditions.

The test results are shown in Tables 1 and 2 below.

TABLE 1*

| TEST SAMPLES | ΔE |
|---|---|
| Control | |
| White cloth | 0 |
| No polymer | 33 |
| Invention Polymers | |
| Example 1 (Polymer A; 100% quat) | 6.6 |
| Example 2 (Polymer A; 75% quat) | 7.7 |
| Example 3 (Polymer A; 50% quat) | 10.4 |
| Example 4 (Copolymer of VPyr + VP; 100% quat) (50:50)** | 10.9 |
| Example 5 (Copolymer of VPyr + VP; 100% quat) (25:75)** | 14.3 |
| Other Polymers | ΔE |
| PVP | 23.7 |
| PVPNO | 11.9 |
| PVI | 10.1 |
| PVP + PVI (60:40) | 8.2 |

*Direct Red 80
**Weight percent

TABLE 2*

| TEST SAMPLES | ΔE |
|---|---|
| Control | |
| No polymer | 34.2 |
| Invention Polymers | |
| Polymer A | 21.7 |
| Other Polymers | |
| PVP | 28.1 |
| PVPNO | 25.7 |
| P (VI-VP) | 31.7 |

*The dye was Direct Blue No. 1

The compositions of the invention also may be used as soil anti-redeposition formulations. The test results for such formulations are given below.

TEST RESULTS FOR SOIL ANTI-REDEPOSITION

The effectiveness of the polymers of the invention, to prevent redeposition of soil in a laundry detergent composition was tested against control and other known polymers in a test simulating actual laundry washing conditions. The test was carried out on a composition containing 2 gm/L of Dust Sebum and 50 ppm of the polymer in solution. The solution was diluted with water to 1-l.

Three white polycotton cloth (polyester-cotton 65:35) swatches were immersed in the test solution maintained at 100° F. and the solutions were agitated for 10 minutes in a Terg-o-tometer (Instrument Marketing Services Co.). The cloths were then removed, excess solution squeezed out, the cloths washed again in clean water for 3 minutes, squeezed again and dried. Reflectance measurements were taken on this test material on a calorimeter. The reflectance readings were recorded at 460 nm, and the difference with respect to the blank was recorded. The closer the reflectance to a white cloth, the higher is the polymer's ability in preventing soil redeposition. These readings were taken as a direct measure of the degree of soil deposition under the test washing conditions.

The test results are shown in Tables 3 and 4 below.

TABLE 3*

| TEST SAMPLES | $\Delta R_d$ |
|---|---|
| Control | |
| White cloth | 0 |
| No polymer | −59 |
| Invention Polymers | |
| Example 1 (Polymer A; 100% quat) | −20 |
| Other Polymers | |
| PVP | −48 |
| CMC | −46 |

*The soil used was dust sebum on nylon cloth

TABLE 4*

| TEST SAMPLES | $\Delta R_d$ |
|---|---|
| Control | |
| No polymer | −16 |
| Invention Polymers | |
| Polymer A | −1 |
| Other Polymers | |
| PVP | −10 |
| CMC | −13 |

*The soil used was dust sebum on nylon cloth

While the invention has been described with particular reference to certain embodiments thereof, it will be understood that changes and modifications may be made which are within the skill of the art. Accordingly, it is intended to be bound only by the following claims, in which:

What is claimed is:

1. A laundry detergent composition including (a) 0.001–15% by weight of a dye transfer inhibiting amount of a water soluble poly(4-vinylpyridine betaine) polymer containing a quaternary nitrogen and a carboxylate salt having the formula:

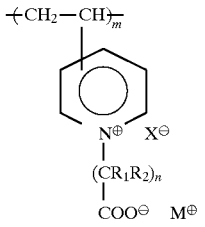

where m defines a repeating unit;

X is an anion;

$R_1$ and $R_2$ are independently hydrogen, alkyl or aryl;

n is 1–5; and

M is a cation; and copolymers thereof; (b) a cleaning effective amount of a surfactant system comprising a surfactant selected from anionic, nonionic, cationic, ampholytic, zwitterionic, semi-polar surfactants or mixtures thereof, wherein said composition is in the form of a granular or aqueous liquid detergent composition.

2. A composition according to claim 1 in which X is a halide.

3. A composition according to claim 2 in which X is chloride or bromide.

4. A composition according to claim 3 in which the polymer has a weight average molecular weight of about 1,000 to 1,000,000.

5. A composition according to claim 1 in which $R_1$ and $R_2$ are both hydrogen.

6. A composition according to claim 1 in which n is 1.

7. A composition according to claim 1 in which M is an alkali metal.

8. A composition according to claim 7 in which M is sodium or potassium.

9. A composition according to claim 1 in which m is 5–5000.

10. A composition according to claim 9 in which m is 20–1000.

11. A composition according to claim 1 in which the polymer is 25–100% quaternized.

12. A composition according to claim 11 in which the polymer is 75–100% quaternized.

13. A composition according to claim 1 in which the dye transfer inhibitor is a water soluble copolymer of the betaine and a polymerizable monomer.

14. A composition according to claim 13 in which polymerizable monomer is a vinylpyrrolidone, vinyl caprolactam, vinyl imidazole, N-vinyl formamide or acrylamide.

15. A composition according to claim 1 in which the dye transfer inhibitor polymer is poly(4-vinylpyridine) sodium carboxymethyl betaine chloride.

16. A composition according to claim 1 which includes about 0.01–10 wt. % of the betaine polymer or copolymer.

17. A composition according to claim 1 which includes about 0.1–5.0 wt. % of the betaine polymer or copolymer.

18. A composition according to claim 1 in which said surfactant system includes an anionic surfactant.

19. A composition according to claim 1 further comprising builders, chelants, bleaching agents, organic solvents, suds supressor, soil release agents, antiredeposition agents, optical brighteners, abrasives, bactericides, tarnish inhibitors, coloring agents, perfumes, or mixtures thereof.

20. A composition according to claim 1 which further comprises a soil anti-redeposition agent.

* * * * *